US009364944B2

(12) United States Patent
Aoki

(10) Patent No.: US 9,364,944 B2
(45) Date of Patent: Jun. 14, 2016

(54) POWER TOOL

(75) Inventor: Yonosuke Aoki, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 677 days.

(21) Appl. No.: 13/505,110

(22) PCT Filed: Oct. 20, 2010

(86) PCT No.: PCT/JP2010/068483

§ 371 (c)(1),
(2), (4) Date: Jun. 26, 2012

(87) PCT Pub. No.: WO2011/052451

PCT Pub. Date: May 5, 2011

(65) Prior Publication Data

US 2012/0255756 A1 Oct. 11, 2012

(30) Foreign Application Priority Data

Nov. 2, 2009 (JP) ..... 2009-251931

(51) Int. Cl.
*B25B 23/14* (2006.01)
*B24B 23/02* (2006.01)
(Continued)

(52) U.S. Cl.
CPC ..... *B25B 23/14* (2013.01); *B24B 23/02* (2013.01); *B24B 47/26* (2013.01); *B24B 55/00* (2013.01);
(Continued)

(58) Field of Classification Search
CPC ..... B25D 16/003; B25D 2250/145; B25D 2250/165; B25D 2250/221; B25D 2216/0069; B25D 2250/205; B25B 23/14
USPC ..... 173/1, 2, 5, 176, 180, 181, 217, 6, 8; 192/84.96
See application file for complete search history.

(56) References Cited

U.S. PATENT DOCUMENTS 5,584,619 A * 12/1996 Guzzella ..... 408/9
5,914,882 A * 6/1999 Yeghiazarians ..... 700/177
(Continued)

FOREIGN PATENT DOCUMENTS

EP 0 666 148 B1 8/1995
JP A 2002-224975 8/2002
(Continued)

OTHER PUBLICATIONS

Jan. 7, 2014 Office Action issued in Japanese Application No. 2009-251931.
(Continued)

*Primary Examiner* — Stephen F Gerrity
*Assistant Examiner* — Eyamindae Jallow
(74) *Attorney, Agent, or Firm* — Oliff PLC

(57) ABSTRACT

Provided is a power tool which is capable of more reliably detecting excessive reaction torque acting on a tool body. More specifically, provided is a handheld power tool which causes a tip tool to rotate so as to carry out a predetermined machining operation, the handheld power tool comprising a tool body, a motor which is housed in the tool body and causes the tip tool to rotate, a first sensor which detects the torque state of the tip tool, a second sensor which detects the motion state of the tool body, and a torque cut-off mechanism which cuts off the transmission of torque between the motor and the tip tool. The torque cut-off mechanism is configured to cut off the transmission of torque on the condition that the first sensor and the second sensor respectively detect a preset threshold value for the first sensor and the second sensor.

13 Claims, 3 Drawing Sheets

(51) Int. Cl.

| | |
|---|---|
| ***B24B 47/26*** | (2006.01) |
| ***B24B 55/00*** | (2006.01) |
| ***B25D 16/00*** | (2006.01) |
| ***B25F 5/00*** | (2006.01) |

(52) U.S. Cl.

CPC ..... *B25D 16/003* (2013.01); *B25D 16/006* (2013.01); *B25F 5/00* (2013.01); *B25D 2211/068* (2013.01); *B25D 2216/0015* (2013.01); *B25D 2216/0023* (2013.01); *B25D 2216/0069* (2013.01); *B25D 2250/145* (2013.01); *B25D 2250/165* (2013.01); *B25D 2250/205* (2013.01); *B25D 2250/221* (2013.01); *B25D 2250/255* (2013.01)

(56) References Cited

U.S. PATENT DOCUMENTS

| | | | | |
|---|---|---|---|---|
| 6,415,875 | B1 * | 7/2002 | Meixner et al. | 173/2 |
| 6,836,614 | B2 * | 12/2004 | Gilmore | 388/811 |
| 6,981,557 | B2 * | 1/2006 | Boeni et al. | 173/1 |
| 7,055,620 | B2 * | 6/2006 | Nadig et al. | 173/2 |
| 7,410,006 | B2 * | 8/2008 | Zhang et al. | 173/1 |
| 7,681,659 | B2 * | 3/2010 | Zhang et al. | 173/1 |
| 7,987,919 | B2 * | 8/2011 | Paprocki | 173/2 |
| 8,833,484 | B2 * | 9/2014 | Binder et al. | 173/1 |
| 2002/0033267 | A1 * | 3/2002 | Schweizer et al. | 173/2 |
| 2002/0066632 | A1 * | 6/2002 | Kristen et al. | 192/17 C |
| 2005/0045353 | A1 * | 3/2005 | Kawai et al. | 173/181 |
| 2005/0161241 | A1 * | 7/2005 | Frauhammer et al. | 173/1 |
| 2005/0263304 | A1 * | 12/2005 | Sainomoto et al. | 173/2 |
| 2006/0081386 | A1 * | 4/2006 | Zhang et al. | 173/2 |
| 2006/0124331 | A1 * | 6/2006 | Stirm et al. | 173/178 |
| 2007/0114049 | A1 * | 5/2007 | Steverding et al. | 173/4 |
| 2009/0139738 | A1 * | 6/2009 | Lippek | 173/181 |
| 2009/0255700 | A1 * | 10/2009 | Lehnert et al. | 173/104 |
| 2012/0255752 | A1 * | 10/2012 | Aoki | 173/48 |
| 2012/0255756 | A1 * | 10/2012 | Aoki | 173/178 |
| 2012/0261150 | A1 * | 10/2012 | Aoki | 173/104 |
| 2012/0318552 | A1 * | 12/2012 | May | 173/181 |
| 2013/0087355 | A1 * | 4/2013 | Oomori et al. | 173/47 |
| 2013/0126202 | A1 * | 5/2013 | Oomori et al. | 173/217 |
| 2013/0240230 | A1 * | 9/2013 | Saur | 173/178 |
| 2013/0319710 | A1 * | 12/2013 | Aoki et al. | 173/178 |
| 2013/0341058 | A1 * | 12/2013 | Roehm | 173/178 |

FOREIGN PATENT DOCUMENTS

| | | |
|---|---|---|
| JP | A-2004-226015 | 8/2004 |
| JP | A 2008-516789 | 5/2008 |
| JP | A-2008-272880 | 11/2008 |
| WO | WO 2006/057141 A1 | 6/2006 |

OTHER PUBLICATIONS

Jun. 21, 2012 International Preliminary Report on Patentability issued in International Patent Application No. PCT/JP2010/068483; with English-language translation.

International Search Report issued in International Patent Application No. PCT/JP2010/068483; mailed Feb. 1, 2011.

Oct. 13, 2014 Office Action issued in Russian Application No. 2012122755/02(034601).

May 15, 2015 Search Report issued in European Application No. 10826583.6.

* cited by examiner

POWER TOOL

FIELD OF THE INVENTION

The present invention relates to a power tool which is capable of detecting excessive reaction torque acting on a tool body when a tool bit is unintentionally locked.

BACKGROUND OF THE INVENTION

European Patent No. 0666148 discloses a hammer drill having a means for detecting reaction torque acting on a tool body in a direction opposite to a direction of rotation of a hammer bit. In a power tool such as a hammer drill, when a hammer bit is unintentionally locked during hammer drill operation, reaction torque acting on the tool body increases so that the tool body may be swung. In the above-described known hammer drill, a rotation sensor is provided which monitors rotation of the tool body when the tool body rotates around a rotation axis of the hammer bit by reaction torque acting on the tool body. The rotation sensor predicts a future uncontrollability of the tool body from angles observed within a fixed period of time and interrupts torque transmission between the motor and the hammer bit.

In the construction in which the rotation sensor is used to predict a future uncontrollability of the tool body, for example, when the user performs an operation while rapidly moving the tool body on his or her own will, even if the tool body is not rendered uncontrollable, the rotation sensor may incorrectly determine the tool body to be uncontrollable and interrupt torque transmission. Specifically, in the known technique of detecting reaction torque acting on the tool body by the rotation sensor, further improvement is required in accuracy of detection.

DISCLOSURE OF THE INVENTION

Problems to be Solved by the Invention

Accordingly, it is an object of the present invention to provide a power tool which can more reliably detect excessive reaction torque acting on a tool body.

Means for Solving the Problems

In order to solve the above-described problem, according to a preferred embodiment of the present invention, a hand-held power tool is provided which performs a predetermined operation by rotationally driving a tool bit. The "power tool" according to this invention typically represents an electric hammer drill which performs a hammer drill operation by impact driving and rotation driving of the tool bit, or an electric drill which performs a drilling operation on a workpiece by rotation driving of the tool bit, but it also suitably includes a grinding or polishing tool such as an electric disc grinder for performing grinding or polishing operation on a workpiece, a rotary cutting machine such as a circular saw for cutting a workpiece, and a screw tightening machine for screw tightening operation.

In this invention, the power tool includes a tool body, a motor that is housed in the tool body and rotationally drives the tool bit, a first sensor that detects torque of the tool bit, a second sensor that detects motion of the tool body, and a torque transmission interrupting mechanism that can interrupt torque transmission between the motor and the tool bit. The torque transmission interrupting mechanism interrupts torque transmission, provided that the first sensor and the second sensor detect preset thresholds of the first sensor and the second sensor. The manner of "detecting torque" in this invention widely includes not only the manner of directly detecting torque acting on the tool bit, but the manner of detecting torque acting on components or parts directly relating to power transmission from the motor to the tool bit. Further, the manner of "detecting motion" in this invention suitably includes not only the manner of directly detecting motion of the tool body, but the manner of detecting motion of components or parts integrally formed with the tool body. The "torque transmission interrupting mechanism" in this invention typically represents a clutch that transmits torque or interrupts torque transmission, but it may suitably include a de-energizing device which de-energizes the motor, or a brake which stops rotation of the motor or reduces its speed.

According to this invention, when the tool bit is unintentionally locked during operation by rotation driving of the tool bit, it can be reliably determined that reaction torque acting on the tool boy is increased and the tool body is uncontrollable for the user, provided that the first sensor for detecting torque of the tool bit and the second sensor for detecting motion of the tool body detect their respective preset thresholds. Upon such determination, the torque transmission interrupting mechanism interrupts torque transmission between the motor and the tool bit, so that the above-described uncontrollable state can be avoided. Therefore, for example, when the user performs an operation while swinging the tool body around the rotation axis of the tool bit on his or her own will, even if the second sensor for detecting motion of the tool body detects its threshold, unless the first sensor for detecting torque of the tool bit detects its threshold, torque transmission between the motor and the tool bit is maintained, so that the user can continue the operation.

According to a further embodiment of the present invention, the first sensor is a torque sensor that measures torque or a rate of change of torque per unit time. Torque acting on the tool bit can be reliably detected by using the torque sensor.

According to a further embodiment of the present invention, the second sensor is a speed sensor or an acceleration sensor that measures momentum of the tool body. Motion of the tool body can be reliably detected by using the speed sensor or acceleration sensor.

According to a further embodiment of the present invention, the torque transmission interrupting mechanism is configured as an electromagnetic clutch including a driving-side rotating member, a driven-side rotating member, a biasing member that biases the rotating members away from each other so as to interrupt torque transmission, and an electromagnetic coil that brings the rotating members into contact with each other against the biasing force of the biasing member and thereby transmits torque when the electromagnetic coil is energized. According to this invention, by using the electromagnetic clutch as the torque transmission interrupting mechanism, torque transmission and interruption can be easily controlled and the torque transmission interrupting mechanism can be reduced in size.

Effect of the Invention

According to this invention, a power tool is provided which can more reliably detect excessive reaction torque acting on a tool body. Other objects, features and advantages of the present invention will be readily understood after reading the following detailed description together with the accompanying drawings and the claims.

REPRESENTATIVE EMBODIMENT OF THE INVENTION

Each of the additional features and method steps disclosed above and below may be utilized separately or in conjunction with other features and method steps to provide and manufacture improved power tools and methods for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
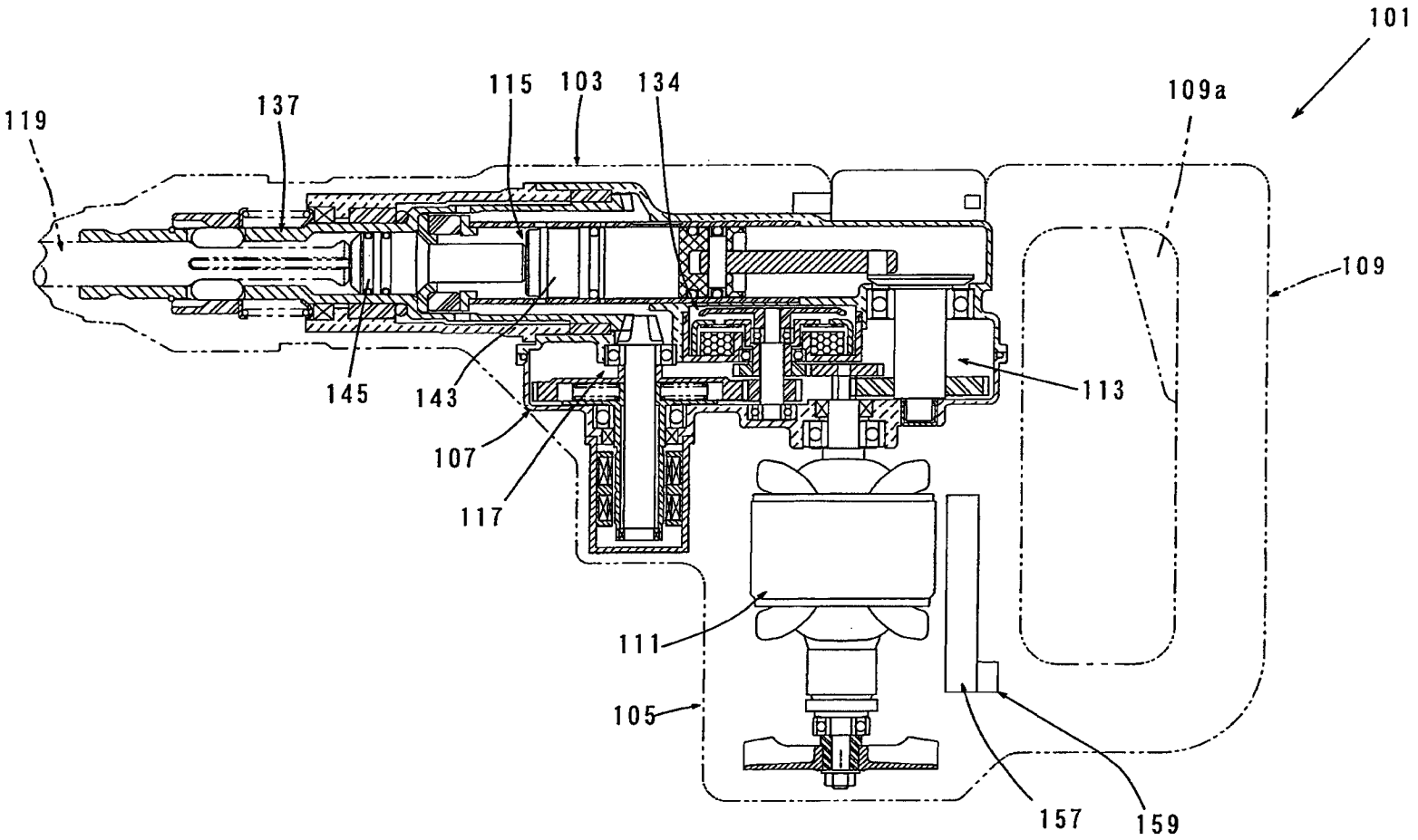
FIG. 1 is a sectional side view showing an entire structure of a hammer drill according to an embodiment of the present invention.

A representative embodiment of the present invention is now described with reference to FIGS. 1 to 4. In this embodiment, an electric hammer drill is explained as a representative example of the power tool. As shown in FIG. 1, the hammer drill 101 according to this embodiment mainly includes a body 103 that forms an outer shell of the hammer drill 101, a hammer bit 119 detachably coupled to a front end region (on the left as viewed in FIG. 1) of the body 103 via a hollow tool holder 137, and a handgrip 109 designed to be held by a user and connected to the body 103 on the side opposite to the hammer bit 119. The hammer bit 119 is held by the tool holder 137 such that it is allowed to linearly move with respect to the tool holder in its axial direction. The body 103 and the handgrip 109 are features that correspond to the "tool body", and the hammer bit 119 is a feature that corresponds to the "tool bit" according to the present invention. In this embodiment, for the sake of convenience of explanation, the side of the hammer bit 119 is taken as the front and the side of the handgrip 109 as the rear.

The body 103 includes a motor housing 105 that houses a driving motor 111, and a gear housing 107 that houses a motion converting mechanism 113, a striking mechanism 115 and a power transmitting mechanism 117. The driving motor 111 is arranged such that its rotation axis runs in a vertical direction (vertically as viewed in FIG. 1) substantially perpendicular to a longitudinal direction of the body 103 (the axial direction of the hammer bit 119). The motion converting mechanism 113 appropriately converts torque (rotating output) of the driving motor 111 into linear motion and then transmits it to the striking mechanism 115. Then, an impact force is generated in the axial direction of the hammer bit 119 (the horizontal direction as viewed in FIG. 1) via the striking mechanism 115. The driving motor 111 is a feature that corresponds to the "motor" according to this invention. The motion converting mechanism 113 and the striking mechanism 115 form an "impact drive mechanism".

Further, the power transmitting mechanism 117 appropriately reduces the speed of torque of the driving motor 111 and transmits it to the hammer bit 119 via the tool holder 137, so that the hammer bit 119 is caused to rotate in its circumferential direction. The driving motor 111 is driven when a user depresses a trigger 109*a* disposed on the handgrip 109. The power transmitting mechanism 117 forms a "rotary drive mechanism".

Figure 2:
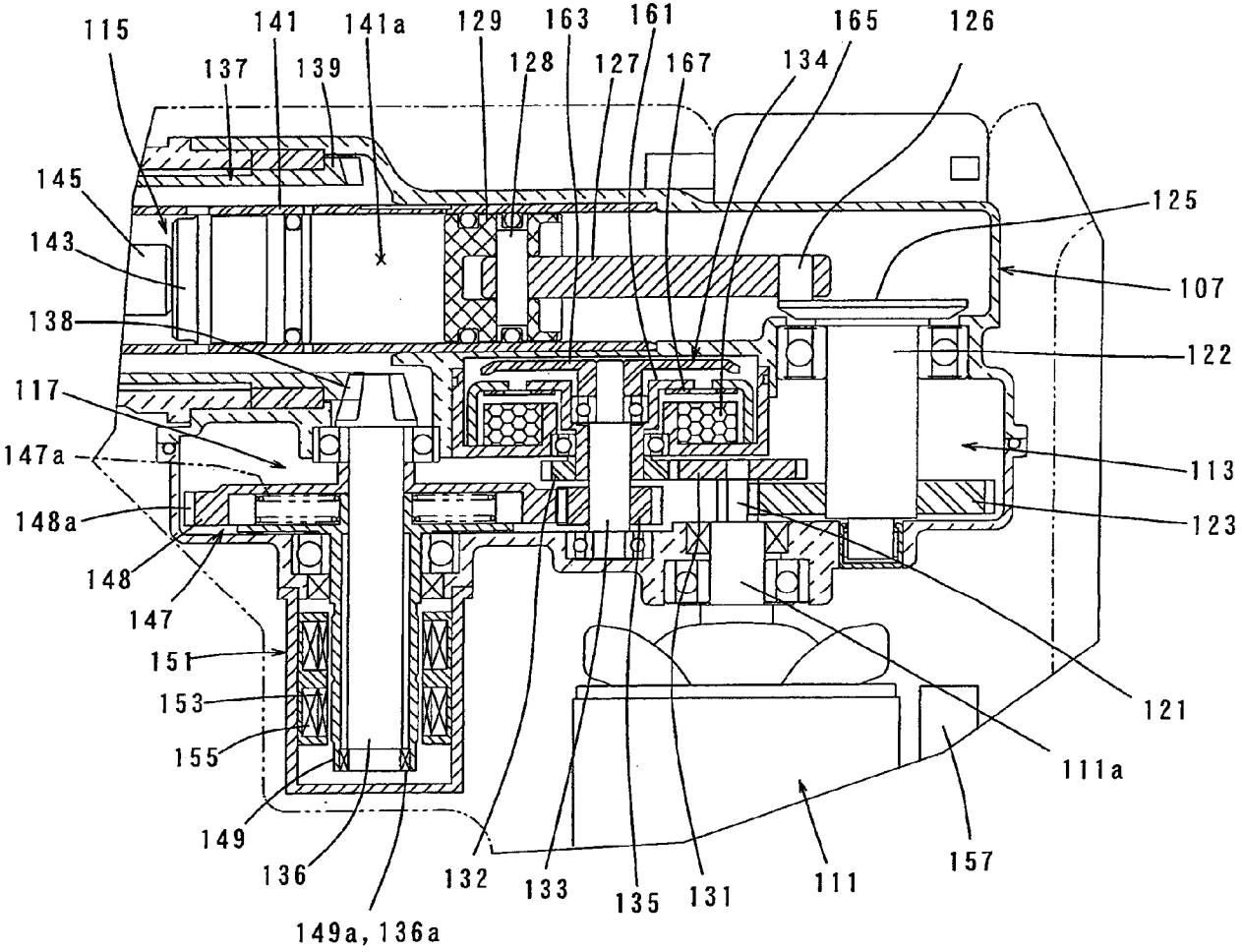
FIG. 2 is an enlarged sectional view showing an essential part of the hammer drill.

As shown in FIG. 2, the motion converting mechanism 113 mainly includes a first driving gear 121 that is formed on an output shaft (rotating shaft) 111*a* of the driving motor 111 and caused to rotate in a horizontal plane, a driven gear 123 that engages with the first driving gear 121, a crank shaft 122 to which the driven gear 123 is fixed, a crank plate 125 that is caused to rotate in a horizontal plane together with the crank shaft 122, a crank arm 127 that is loosely connected to the crank plate 125 via an eccentric shaft 126, and a driving element in the form of a piston 129 which is mounted to the crank arm 127 via a connecting shaft 128. The output shaft 111*a* of the driving motor 111 and the crank shaft 122 are disposed side by side in parallel to each other. The crank shaft 122, the crank plate 125, the eccentric shaft 126, the crank arm 127 and the piston 129 form a crank mechanism. The piston 129 is slidably disposed within a cylinder 141. When the driving motor 111 is driven, the piston 129 is caused to linearly move in the axial direction of the hammer bit 119 along the cylinder 141.

The striking mechanism 115 mainly includes a striking element in the form of a striker 143 slidably disposed within the bore of the cylinder 141, and an intermediate element in the form of an impact bolt 145 that is slidably disposed within the tool holder 137 and serves to transmit kinetic energy of the striker 143 to the hammer bit 119. An air chamber 141*a* is formed between the piston 129 and the striker 143 in the cylinder 141. The striker 143 is driven via pressure fluctuations (air spring action) of the air chamber 141*a* of the cylinder 141 by sliding movement of the piston 129. The striker 143 then collides with (strikes) the impact bolt 145 which is slidably disposed in the tool holder 137. As a result, a striking force caused by the collision is transmitted to the hammer bit 119 via the impact bolt 145. Specifically, the motion converting mechanism 113 and the striking mechanism 115 for driving the hammer bit 119 by impact are directly connected to the driving motor 111.

The power transmitting mechanism 117 mainly includes a second driving gear 131, a first intermediate gear 132, a first intermediate shaft 133, an electromagnetic clutch 134, a second intermediate gear 135, a mechanical torque limiter 147, a second intermediate shaft 136, a small bevel gear 138, a large bevel gear 139 and the tool holder 137. The power transmitting mechanism 117 transmits torque of the driving motor 111 to the hammer bit 119. The second driving gear 131 is fixed to the output shaft 111*a* of the driving motor 111 and caused to rotate in the horizontal plane together with the first driving gear 121. The first and second intermediate shafts 133, 136 are located downstream from the output shaft 111*a* in terms of torque transmission and disposed side by side in parallel to the output shaft 111*a*. The first intermediate shaft 133 is provided as a shaft for mounting the clutch and disposed between the output shaft 111*a* and the second intermediate shaft 136. The first intermediate shaft 133 is rotated via the electromagnetic clutch 134 by the first intermediate gear 132 which is constantly engaged with the second driving gear 131. The speed ratio of the first intermediate gear 132 to the second driving gear 131 is set to be almost the same.

The electromagnetic clutch 134 serves to transmit torque or interrupt torque transmission between the driving motor 111 and the hammer bit 119 or between the output shaft 111*a* and the second intermediate shaft 136, and is a feature that corresponds to the "torque transmission interrupting mechanism". Specifically, the electromagnetic clutch 134 is disposed on the first intermediate shaft 133 and serves to prevent the body 103 from being swung when the hammer bit 119 is unintentionally locked and reaction torque acting on the body 103 excessively increases. The electromagnetic clutch 134 is disposed above the first intermediate gear 132 in the axial direction of the first intermediate shaft 133 and located closer to the axis of motion (axis of striking movement) of the striker 143 than the first intermediate gear 132. Specifically, the power transmitting mechanism 117 for rotationally driving the hammer bit 119 is constructed to transmit torque of the driving motor 111 or interrupt the torque transmission via the electromagnetic clutch 134.

Figure 3:
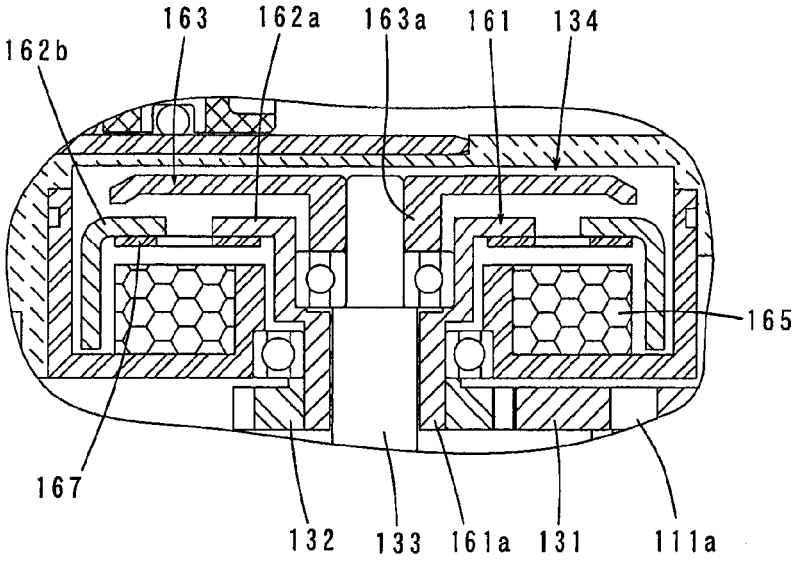
FIG. 3 is an enlarged sectional view showing a clutch in a torque transmission interrupted state.
Figure 4:
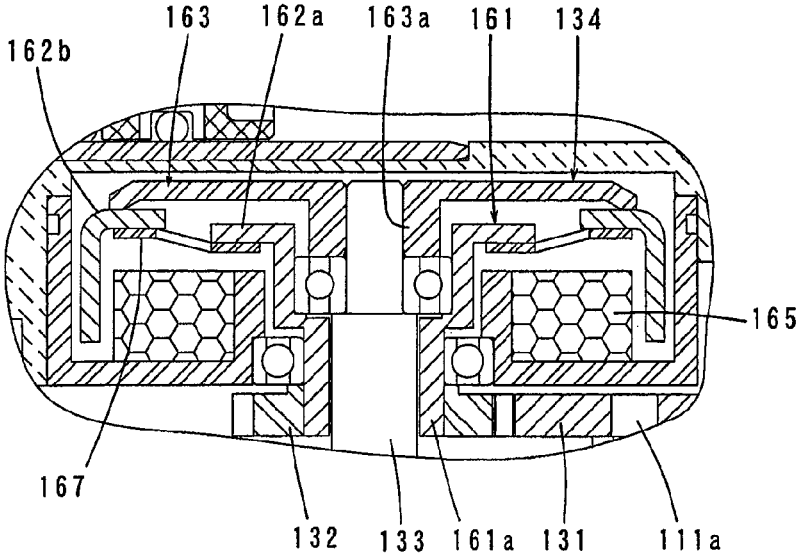
FIG. 4 is an enlarged sectional view showing the clutch in a torque transmission state.

As shown in FIGS. 3 and 4, the electromagnetic clutch 134 mainly includes a circular cup-shaped driving-side rotating member 161 and a disc-like driven-side rotating member 163 which are opposed to each other in their axial direction, a biasing member in the form of a spring disc 167 which constantly biases the driving-side rotating member 161 in a direction that releases engagement (frictional contact) between the driving-side rotating member 161 and the driven-side rotating member 163, and an electromagnetic coil 165 that engages the driving-side rotating member 161 with the driven-side rotating member 163 against the biasing force of the spring disc 167 when it is energized.

A driving-side clutch part in the form of the driving-side rotating member 161 has a shaft (boss) 161*a* protruding downward. The shaft 161*a* is fitted onto the first intermediate shaft 133 and can rotate around its axis with respect to the first intermediate shaft 133. Further, the first intermediate gear 132 is fixedly mounted on the shaft 161*a*. Therefore, the driving-side rotating member 161 and the first intermediate gear 132 rotate together. A driven-side clutch part in the form of the driven-side rotating member 163 also has a shaft (boss) 163*a* protruding downward and the shaft 163*a* is integrally fixed on one axial end (upper end) of the first intermediate shaft 133. Thus, the driven-side rotating member 163 can rotate with respect to the driving-side rotating member 161. When the first intermediate shaft 133 integrated with the shaft 163*a* of the driven-side rotating member 163 is viewed as part of the shaft 163*a*, the shaft 163*a* and the shaft 161*a* of the driving-side rotating member 161 are coaxially disposed radially inward and outward. Specifically, the shaft 163*a* of the driven-side rotating member 163 is disposed radially inward, and the shaft 161*a* of the driving-side rotating member 161 is disposed radially inward. The shaft 161*a* of the driving-side rotating member 161, the shaft 163*a* of the driven-side rotating member 163 and the first intermediate shaft 133 form a clutch shaft.

Further, the driving-side rotating member 161 is divided into a radially inner region 162*a* and a radially outer region 162*b*, and the inner and outer regions 162*a*, 162*b* are connected by the spring disc 167 and can move in the axial direction with respect to each other. The outer region 162*b* is provided and configured as a movable member which comes into frictional contact with the driven-side rotating member 163. In the electromagnetic clutch 134 having the above-described construction, the outer region 162*b* of the driving-side rotating member 161 is displaced in the axial direction by energization or de-energization of the electromagnetic coil 165 based on a command from a controller 157. Torque is transmitted to the driven-side rotating member 163 when the electromagnetic clutch 134 comes into engagement (frictional contact) with the driven-side rotating member 163 (see FIG. 4), while the torque transmission is interrupted when this engagement is released (see FIG. 3).

Further, as shown in FIG. 2, the second intermediate gear 135 is fixed on the other axial end (lower end) of the first intermediate shaft 133, and torque of the second intermediate gear 135 is transmitted to the second intermediate shaft 136 via the mechanical torque limiter 147. The mechanical torque limiter 147 is provided as a safety device against overload on the hammer bit 119 and interrupts torque transmission to the hammer bit 119 when excessive torque exceeding a set value (hereinafter also referred to as a maximum transmission torque value) acts upon the hammer bit 119. The mechanical torque limiter 147 is coaxially mounted on the second intermediate shaft 136.

The mechanical torque limiter 147 includes a driving-side member 148 having a third intermediate gear 148*a* which is engaged with the second intermediate gear 135, and a hollow driven-side member 149 which is loosely fitted on the second intermediate shaft 136. Further, in one axial end region (lower end region as viewed in FIG. 2) of the driven-side member 149, teeth 149*a* and 136*a* formed in the driven-side member 149 and the second intermediate shaft 136 are engaged with each other. With such a construction, the mechanical torque limiter 147 and the second intermediate shaft 136 are caused to rotate together. The speed ratio of the third intermediate gear 148*a* of the driving-side member 148 to the second intermediate gear 135 is set such that the third intermediate gear 148*a* rotates at a reduced speed compared with the second intermediate gear 135. Although not particularly shown, when the torque acting on the second intermediate shaft 136 (which corresponds to the torque acting on the hammer bit 119) is lower than or equal to the maximum transmission torque value which is preset by a spring 147*a*, torque is transmitted between the driving-side member 148 and the driven-side member 149. However, when the torque acting on the second intermediate shaft 136 exceeds the maximum transmission torque value, torque transmission between the driving-side member 148 and the driven-side member 149 is interrupted.

Further, torque transmitted to the second intermediate shaft 136 is transmitted at a reduced rotation speed from a small bevel gear 138 which is integrally formed with the second intermediate shaft 136, to a large bevel gear 139 which is rotated in a vertical plane in engagement with the small bevel gear 138. Moreover, torque of the large bevel gear 139 is transmitted to the hammer bit 119 via a final output shaft in the form of the tool holder 137 which is connected with the large bevel gear 139.

Further, as shown in FIG. 2, a non-contact magnetostrictive torque sensor 151 is installed in the power transmitting mechanism 117 and serves to detect torque acting on the hammer bit 119 during operation. The magnetostrictive torque sensor 151 is a feature that corresponds to the "first sensor that detects torque of the tool bit" according to this invention. The magnetostrictive torque sensor 151 serves to measure torque acting on the driven-side member 149 of the mechanical torque limiter 147 in the power transmitting mechanism 117. The magnetostrictive torque sensor 151 has an exciting coil 153 and a detecting coil 155 around an inclined groove formed in an outer circumferential surface of a torque detecting shaft in the form of the driven-side member 149. In order to measure the torque, the magnetostrictive torque sensor 151 detects change in magnetic permeability of the inclined groove of the driven-side member 149 as a voltage change by the detecting coil 155 when the driven-side member 149 is turned.

Further, as shown in FIGS. 1 and 2, an acceleration sensor 159 is mounted on the controller 157 and serves to detect rotation of the body 103 around the axis of the hammer bit 119. The acceleration sensor 159 is a feature that corresponds to the "second sensor that detects motion of the tool bit" according to this invention. In this embodiment, by providing the acceleration sensor 159 on the controller 157, the acceleration sensor 159 is located closer to the controller 157, so that electrical connection therebetween can be made easier. Further, the mounting position of the acceleration sensor 159 is not limited to the controller 157, but it may also be any position (any member which moves together with the body 103) on which it can detect motion of the body 103 or the handgrip 109. In order to enhance sensitivity for detection of the acceleration sensor 159, however, the acceleration sensor 159 is preferably disposed as far as possible from the axis of rotation of the hammer bit 119 in a radial direction transverse to the axial direction.

A torque value measured by the magnetostrictive torque sensor 151 is outputted to the controller 157. Further, a speed or acceleration value measured by the acceleration sensor 159 is outputted to the controller 157. Only when the torque value inputted from the magnetostrictive torque sensor 151 reaches a predetermined torque setting and the acceleration value inputted from the acceleration sensor 159 reaches a predetermined acceleration setting, the controller 157 outputs a de-energization command to the electromagnetic coil 165 of the electromagnetic clutch 134 to disengage the electromagnetic clutch 134. The above-described torque setting and acceleration setting are features that correspond to the "threshold of the first sensor" and the "threshold of the second sensor", respectively, according to this invention. Further, a user can arbitrarily change (adjust) the torque setting by externally manually operating a torque adjusting means (for example, a dial), which is not shown. The torque setting adjusted by the torque adjusting means is limited to within a range lower than the maximum transmission torque value set by the spring 147*a* of the mechanical torque limiter 147. The controller 157 forms a clutch controlling device.

In the hammer drill 101 having the above-described construction, when the user holds the handgrip 109 and depresses the trigger 109 in order to drive the driving motor 111, the piston 129 is caused to rectilinearly slide along the cylinder 141 via the motion converting mechanism 113. By this sliding movement, the striker 143 is caused to rectilinearly move within the cylinder 141 via air pressure fluctuations or air spring action in the air chamber 141*a* of the cylinder 141. The striker 143 then collides with the impact bolt 145, so that the kinetic energy caused by this collision is transmitted to the hammer bit 119.

Torque of the driving motor 111 is transmitted to the tool holder 137 via the power transmitting mechanism 117. As a result, the tool holder 137 is rotated in a vertical plane and the hammer bit 119 is rotated together with the tool holder 137. Thus, the hammer bit 119 performs hammering movement in its axial direction and drilling movement in its circumferential direction, so that a hammer drill operation (drilling operation) is performed on a workpiece (concrete).

The hammer drill 101 according to this embodiment can be switched not only to the above-described hammer drill mode in which the hammer bit 119 is caused to perform hammering movement and drilling movement in its circumferential direction, but to drilling mode in which the hammer bit 119 is caused to perform only drilling movement, or to hammering mode in which the hammer bit 119 is caused to perform only hammering movement. When the operation mode in which the hammer bit 119 is caused to perform drilling movement in its circumferential direction is selected (detected), the controller 157 outputs a command of energization of the electromagnetic coil 165 of the electromagnetic clutch 134. A mode switching mechanism is not directly related to this invention and therefore its description is omitted.

During the above-described hammer drill operation, the magnetostrictive torque sensor 151 measures the torque acting on the driven-side member 149 of the mechanical torque limiter 147 and outputs it to the controller 157. Further, the acceleration sensor 159 measures the acceleration of the body 103 (the controller 157 moving together with the body 103) and outputs it to the controller 157. When the hammer bit 119 is unintentionally locked for any cause and the measured value inputted from the magnetostrictive torque sensor 151 to the controller 157 reaches a torque setting and the measured value inputted from the acceleration sensor 159 to the controller 157 reaches an acceleration setting, the controller 157 outputs a command of de-energization of the electromagnetic coil 165 to disengage the electromagnetic clutch 134. Therefore, the electromagnetic coil 165 is de-energized and thus the electromagnetic force is no longer generated, so that the outer region 162*b* of the driving-side rotating member 161 is separated from the driven-side rotating member 163 by the biasing force of the spring disc 167. Specifically, the electromagnetic clutch 134 is switched from the torque transmission state to the torque transmission interrupted state, so that the torque transmission from the driving motor 111 to the hammer bit 119 is interrupted. Thus, the body 103 can be prevented from being swung by excessive reaction torque acting on the body 103 due to locking of the hammer bit 119.

As described above, according to this embodiment, as for the structure of transmitting torque of the driving motor 111, the impact driving structure is configured to be directly connected to the driving motor, and the electromagnetic clutch 134 is disposed in a rotary drive path of the hammer bit 119 such that only rotation is transmitted via the electromagnetic clutch 134. In such a construction, torque transmission by the electromagnetic clutch 134 is interrupted, provided that the measured value of the magnetostrictive torque sensor 151 which detects torque of the hammer bit 119 reaches a torque setting and the measured value of the acceleration sensor 159 which detects motion of the body 103 reaches an acceleration setting. Therefore, when reaction torque acting on the boy 103 is increased by unintentional locking of the hammer bit 119, the body 103 can be reliably determined to be uncontrollable for the user. Upon such determination, torque transmission by the electromagnetic clutch 134 is interrupted, so that the body 103 is no longer acted upon by the reaction torque and can be avoided from being rendered uncontrollable.

Further, in this embodiment, torque transmission by the electromagnetic clutch 134 is interrupted when the measured value of the magnetostrictive torque sensor 151 exceeds a torque setting. It can however be assumed, for example, that the user sets the torque setting relatively high and performs an operation in readiness for locking of the hammer bit 119. Therefore, in order to cope with such a case, it may be constructed such that the controller 157 determines abnormal increase of torque by monitoring the average value of torque outputted from the magnetostrictive torque sensor 151 or the increase rate of the torque within a unit of time and when it determines the torque has abnormally increased, it executes disengagement of the electromagnetic clutch 134 from the first intermediate gear 132. In the case of such a construction, torque transmission by the electromagnetic clutch 134 can be reliably interrupted when the hammer bit 119 is unintentionally locked. In this case, it may be constructed such that the increase rate of rapidly increasing torque can be controlled.

Further, in this embodiment, the acceleration sensor 159 is used as a motion sensor for detecting motion of the body 103, but a speed sensor may also be used in place of the acceleration sensor 159.

Further, in this embodiment, the electromagnetic clutch 134 is used as a torque transmission interrupting mechanism, but a de-energizing device which de-energizes the driving motor 111, or a brake which stops or reduces the speed of rotation of the driving motor 111 may also be used in place of the electromagnetic clutch 134.

Further, in this embodiment, the electric hammer drill is explained as a representative example of the power tool, but the present invention can also be applied to other power tools such as an electric disc grinder for use in grinding or polishing operation, a rotary cutting machine such as a circular saw for cutting a workpiece, and a screw tightening machine for screw tightening operation.

In view of the scope and spirit of the above-described invention, the following features can be provided.

(1)

"The power tool as defined in any one of claims 1 to 3, wherein the torque transmission interrupting mechanism comprises a de-energizing device that de-energizes the motor."

(2)

"The power tool as defined in any one of claims 1 to 3, wherein the torque transmission interrupting mechanism comprises a braking device that brakes a rotating member for transmitting torque between the motor and the tool bit."

(3)

"The power tool as defined in claim 2, the torque sensor comprises a non-contact torque sensor that detects torque acting on the tool bit during operation in non-contact with a rotating shaft which rotates together with the tool bit."

(4)

"The power tool as defined in claim 4, comprising a controller that outputs a de-energization command to the electromagnetic coil according to detection signals inputted from the first and second sensors and thereby switches the electromagnetic clutch to a torque transmission interrupted state."

(5)

"The power tool as defined in any one of claims 1 to 4 or any one of (1) to (3), wherein the tool bit comprises a hammer bit that performs a predetermined operation on a workpiece by rectilinear movement in an axial direction of the hammer bit and rotation around an axis of the hammer bit."

DESCRIPTION OF NUMERALS

101 hammer drill (power tool)
103 body (tool body)
105 motor housing
107 gear housing
109 handgrip
109*a* trigger
111 driving motor (motor)
111*a* output shaft
113 motion converting mechanism
115 striking mechanism
117 power transmitting mechanism
119 hammer bit (tool bit)
121 first driving gear
122 crank shaft
123 driven gear
125 crank plate
126 eccentric shaft
127 crank arm
128 connecting shaft
129 piston
131 second driving gear
132 first intermediate gear
133 first intermediate shaft
134 electromagnetic clutch (torque transmission interrupting mechanism)
135 second intermediate gear
136 second intermediate shaft
136*a* teeth
137 tool holder
138 small bevel gear
139 large bevel gear
141 cylinder
141*a* air chamber
143 striker
145 impact bolt
147 mechanical torque limiter
147*a* spring
148 driving-side member
148*a* third intermediate gear
149 driven-side member
149*a* teeth
151 magnetostrictive torque sensor (first sensor)
153 exciting coil
155 detecting coil
157 controller
159 acceleration sensor (second sensor)
161 driving-side rotating member
161*a* shaft
162*a* radially inner region
162*b* radially outer region
163 driven-side rotating member
163*a* shaft
165 electromagnetic coil
167 spring disc

I claim:

1. A hand-held power tool, which performs a predetermined operation by rotationally driving a tool bit, comprising:

a tool body, a tool holder that holds the tool bit, a motor that is housed in the tool body and rotationally drives the tool bit, a first intermediate shaft which is connected to an output shaft of the motor, the first intermediate shaft being driven by the motor and transmitting torque, a second intermediate shaft which is disposed between the tool holder and the first intermediate shaft, the second intermediate shaft receiving the torque from the first intermediate shaft and transmitting the torque to the tool holder;

a first sensor that detects torque applied on the second intermediate shaft, a second sensor that detects motion of the tool body, a torque transmission interrupting mechanism that can interrupt torque transmission between the first intermediate shaft and the second intermediate shaft, and a mechanical limiter that is disposed on the second intermediate shaft and is capable of interrupting the torque transmission between the motor and the tool bit, wherein the torque transmission interrupting mechanism interrupts torque transmission between the first intermediate shaft and the second intermediate shaft, when both the torque detected by the first sensor and the motion of the tool body detected by the second sensor reach respective preset threshold, the torque transmission interrupting mechanism does not interrupt the torque transmission between the first intermediate shaft and the second intermediate shaft, when at least one of the torque detected by the first sensor and the motion of the tool body detected by the second sensor does not reach corresponding preset threshold, and the mechanical limiter interrupts the torque transmission between the motor and the tool bit when the torque detected by the first sensor reaches a preset another threshold, which is different from the preset threshold, the mechanical limiter interrupting the torque transmission independently from a detection result of the second sensor.

2. The power tool as defined in claim 1, wherein the first sensor comprises a torque sensor that measures torque or a rate of change of torque per unit time.

3. The power tool as defined in claim 1, wherein the second sensor comprises a speed sensor or an acceleration sensor that measures momentum of the tool body.

4. The power tool as defined in claim 1, wherein the torque transmission interrupting mechanism comprises an electromagnetic clutch including a driving-side rotating member, a driven-side rotating member, a biasing member that biases the rotating members away from each other so as to interrupt torque transmission, and an electromagnetic coil that brings the rotating members into contact with each other against the biasing force of the biasing member and transmits torque when the electromagnetic coil is energized.

5. The power tool as defined in claim 1, wherein the preset another threshold is greater than the preset threshold.

6. The power tool as defined in claim 1, wherein the mechanical limiter interrupts the torque transmission between the second shaft and the tool holder when the torque detected by the first sensor reaches the preset another threshold.

7. The power tool as defined in claim 1, wherein the output shaft of the motor, the first intermediate shaft and the second intermediate shaft extend substantially in parallel with each other.

8. A hand-held power tool, which performs a predetermined operation by rotationally and linearly driving a tool bit, comprising:

a tool body, a motor that is housed in the tool body and rotationally drives the tool bit, an impact drive mechanism that is driven by the motor and linearly drives the tool bit, a rotary drive mechanism that is driven by the motor and rotationally drives the tool bit, a first sensor that detects torque of the tool bit, a second sensor that detects motion of the tool body, an electromagnetic clutch mechanism that is disposed in a rotary drive path and can interrupt transmission of the torque for rotationally driving the tool bit between the motor and the tool bit, and a controller that controls the electromagnetic clutch mechanism based on a detection result of the first sensor and a detection result of the second sensor, wherein the controller controls the electromagnetic clutch mechanism such that when both the torque detected by the first sensor and the motion of the tool body detected by the second sensor reach respective preset threshold, the electromagnetic clutch mechanism interrupts the transmission of the torque in the rotary drive path while a linearly driving of the tool bit by the impact drive mechanism is maintained.

9. The power tool as defined in claim 8, further comprising a mechanical limiter that interrupts the transmission of the torque in the rotary drive path when the torque detected by the first sensor reaches a preset another threshold, which is different from the preset threshold, the mechanical limiter interrupting the torque transmission independently from a detection result of the second sensor.

10. The power tool as defined in claim 9, wherein the preset another threshold is greater than the preset threshold.

11. The power tool as defined in claim 9, wherein:

the rotary drive mechanism includes (i) a first intermediate shaft which is connected to an output shaft of the motor and is driven by the motor and transmits torque, and (ii) a second intermediate shaft which is disposed between the tool bit and the first intermediate shaft, the second intermediate shaft receiving the torque from the first intermediate shaft and transmitting the torque to the tool bit, the controller controls the electromagnetic clutch mechanism such that when both the torque detected by the first sensor and the motion of the tool body detected by the second sensor reach the respective preset threshold, the electromagnetic clutch mechanism interrupts the transmission of the torque between the first shaft and the second shaft, and the mechanical limiter interrupts the transmission of the torque between the second shaft and the tool bit when the torque detected by the first sensor reaches the preset another threshold.

12. The power tool as defined in claim 11, wherein the output shaft of the motor, the first intermediate shaft and the second intermediate shaft extend substantially in parallel with each other.

13. A hand-held power tool, which performs a predetermined operation by rotationally driving a tool bit, comprising:

a tool body, a tool holder that holds the tool bit, a motor that is housed in the tool body and rotationally drives the tool bit, an intermediate shaft which is disposed between the tool holder and the motor, the intermediate shaft being driven by the motor and transmitting torque to the tool holder, a first sensor that detects torque applied on the intermediate shaft, a second sensor that detects motion of the tool body, a torque transmission interrupting mechanism that can interrupt torque transmission between the motor and the tool bit, and a mechanical limiter that is disposed on the intermediate shaft and is capable of interrupting the torque transmission between the motor and the tool bit, wherein the torque transmission interrupting mechanism interrupts torque transmission, when both the torque detected by the first sensor and the motion of the tool body detected by the second sensor reach respective preset threshold, the torque transmission between the motor and the tool bit is maintained when at least one of the torque detected by the first sensor and the motion of the tool body detected by the second sensor does not reach corresponding preset threshold, and the mechanical limiter interrupts the torque transmission between the motor and the tool bit when the torque detected by the first sensor reaches a preset another threshold, which is greater than the preset threshold, the mechanical limiter interrupting the torque transmission independently from a detection result of the second sensor.

* * * * *